US006260287B1

(12) United States Patent
Walker et al.

(10) Patent No.: US 6,260,287 B1
(45) Date of Patent: Jul. 17, 2001

(54) WET WEB STABILITY METHOD AND APPARATUS

(76) Inventors: Peter Walker; Raffaele Mancini, both of 970 Montée de Liesse, Suite 201, Ville St-Laurent, Québec (CA), H4T 1W7

( * ) Notice: Subject to any disclaimer, the term of this patent is extended or adjusted under 35 U.S.C. 154(b) by 0 days.

(21) Appl. No.: 09/559,777

(22) Filed: Apr. 27, 2000

Related U.S. Application Data

(63) Continuation-in-part of application No. 09/130,366, filed on Aug. 7, 1998, now abandoned.
(60) Provisional application No. 60/055,028, filed on Aug. 8, 1997.

(51) Int. Cl.[7] ..... F26B 3/00
(52) U.S. Cl. ..... 34/455; 34/456; 34/114; 34/117; 34/119
(58) Field of Search ..... 34/114–117, 119, 34/120, 123, 454, 455, 456, 457, 458; 162/370, 286

(56) References Cited

U.S. PATENT DOCUMENTS

| | | | | |
|---|---|---|---|---|
| 2,714,342 | | 8/1955 | Beachler . | |
| 2,958,379 | * | 11/1960 | Hornbostel | 162/318 |
| 3,071,869 | * | 1/1963 | Latimer et al. | 34/114 |
| 3,316,657 | * | 5/1967 | Haywood | 34/111 |
| 3,319,354 | * | 5/1967 | Hering, Jr. et al. | 34/155 |
| 3,367,035 | * | 2/1968 | Tomlinson | 34/10 |
| 3,427,727 | * | 2/1969 | Villalobos | 34/155 |
| 3,622,058 | * | 11/1971 | Vits | 34/156 |
| 3,678,599 | * | 7/1972 | Vits | 34/156 |
| 3,680,223 | * | 8/1972 | Vits | 34/156 |
| 3,753,298 | * | 8/1973 | Ely | 34/116 |
| 3,763,571 | * | 10/1973 | Vits | 34/57 A |
| 3,764,085 | * | 10/1973 | Hawkins | 242/56.6 |
| 3,778,903 | | 12/1973 | Gardella . | |
| 3,778,908 | * | 12/1973 | Notbohm | 34/116 |
| 3,861,996 | | 1/1975 | Dorfel . | |

(List continued on next page.)

FOREIGN PATENT DOCUMENTS

| | | |
|---|---|---|
| 1184377 | 3/1985 | (CA) . |
| 1192738 | 9/1985 | (CA) . |
| 1243197 | 10/1988 | (CA) . |
| 1247857 | 1/1989 | (CA) . |
| 1251635 | 3/1989 | (CA) . |
| 1252288 | 4/1989 | (CA) . |
| 1274978 | 10/1990 | (CA) . |
| 1299865 | 5/1992 | (CA) . |
| 1307107 | 9/1992 | (CA) . |
| 1317807 | 5/1993 | (CA) . |
| 1319011 | 6/1993 | (CA) . |
| 2118305 | 9/1994 | (CA) . |
| 2118307 | 9/1994 | (CA) . |
| 1336535 | 8/1995 | (CA) . |
| 1336536 | 8/1995 | (CA) . |
| 2190563 | 5/1998 | (CA) . |

*Primary Examiner*—Pamela Wilson
(74) *Attorney, Agent, or Firm*—Birch, Stewart, Kolash & Birch, LLP

(57) ABSTRACT

A sheet stabilizer is provided for a dryer section of a paper-making machine which conveys a wet sheet of paper by way of a felt or fabric, the dryer roller including a leading upper dryer roller, a lower dryer roller, and a trailing upper dryer roller. The sheet stabilizer comprises upper and lower Venturi boxes, which are disposed between the leading upper dryer roller and the lower drying roller. Each Venturi box provides a respective space defined by fixed parallel outer and inner plates. In use, the wet sheet of paper is in sliding contact with the upper outer plate. The upper and lower Venturi boxes cooperate to draw air from the nip between the wet sheet of paper and the lower dryer roller and into both the upper fixed space and the lower fixed space. The sliding contact between the supported wet sheet of paper and the upper outer plate assures that the air flow does not result in fluttering of the wet sheet of paper.

14 Claims, 3 Drawing Sheets

U.S. PATENT DOCUMENTS 3,874,997 * 4/1975 Kankaanpaa ..... 162/290
4,016,032 * 4/1977 Kankaanpaa ..... 162/305
4,074,841 * 2/1978 Kramer et al. ..... 34/156
4,113,557 * 9/1978 Kankaanpaa ..... 162/301
4,194,947 * 3/1980 Huostila et al. ..... 162/207
4,197,971 * 4/1980 Stibbe ..... 34/57 R
4,238,284 * 12/1980 Huostila et al. ..... 162/207
4,247,993 * 2/1981 Lindstrom ..... 34/156
4,271,601 * 6/1981 Koponen et al. ..... 35/156
4,274,210 * 6/1981 Stengard ..... 34/156
4,321,107 * 3/1982 Page ..... 162/198
4,359,828 11/1982 Thomas .
4,361,466 11/1982 Wong et al. .
4,414,757 11/1983 Whipple .
4,440,598 * 4/1984 Koski et al. ..... 162/305
4,472,888 9/1984 Spiller .
4,477,983 * 10/1984 Andersson et al. ..... 34/114
4,502,231 3/1985 Fissmann et al. .
4,539,762 * 9/1985 Eskelinen et al. ..... 34/114
4,551,203 * 11/1985 Eskelinen ..... 162/202
4,601,116 * 7/1986 Krimsky ..... 35/156
4,625,434 * 12/1986 Karlsson et al. ..... 34/114
4,628,618 * 12/1986 Virta et al. ..... 34/116
4,648,942 * 3/1987 Wanke et al. ..... 162/286
4,669,198 * 6/1987 Wedel ..... 34/23
4,684,443 * 8/1987 Kertula et al. ..... 162/255
4,686,777 * 8/1987 Cooke ..... 34/116
4,694,587 * 9/1987 Eskelinen ..... 34/23
4,698,919 * 10/1987 Wedel ..... 34/117
4,856,205 8/1989 Meyer et al. .
4,875,976 * 10/1989 Wedel ..... 162/306
4,891,891 * 1/1990 Wedel ..... 34/23
4,899,463 * 2/1990 Heikkila et al. ..... 34/23
4,932,140 6/1990 Lepisto .
4,953,297 9/1990 Eskelinen et al. .
4,986,009 1/1991 Haessner et al. .
5,019,213 * 5/1991 Virta et al. ..... 162/193
5,022,166 6/1991 Nguyen et al. .
5,024,729 6/1991 Kuhasalo et al. .
5,074,278 12/1991 Turcotte .
5,086,571 2/1992 Hietanen .
5,325,608 7/1994 Mayer .
5,379,526 * 1/1995 Haverinen ..... 34/114
5,577,294 11/1996 Pollock .
5,635,030 6/1997 Meschenmo et al. .
5,738,760 4/1998 Svanqvist et al. .
5,792,318 8/1998 Mancini .
5,820,733 10/1998 Mancini .

* cited by examiner

WET WEB STABILITY METHOD AND APPARATUS

RELATED INVENTIONS

This application is a continuation-in-part of application Ser. No. 09/130,366 filed Aug. 7, 1998 now abandoned, the entire contents of which are incorporated herein by reference.

This application claims the benefit of Provisional application Ser. No. 60/055,028 filed Aug. 8, 1997.

BACKGROUND OF THE INVENTION (a) Field of the Invention

This invention relates to a method and apparatus for carrying a delicate wet paper web on a high speed paper drying machine in the first and second dryer sections.

(b) Description of the Prior Art

On high speed paper drying machines, single felts or fabrics are often used to carry the delicate paper web in the first and second dryer sections. Although the web is fully supported, it can become detached from the felt or fabric at the vacuum wedge as the web adheres to the dryer cylinder, and because of the small vacuum formed as the two surfaces separate. The greater potential problem is at the compression wedge formed between the felt or fabric and the dryer. A large volume of air is carried by the boundary layer on the felt or fabric and this is forced into the nip and pushed through the permeable felt or fabric, to detach the web.

Instabilities in the sheet run in the single-felted paper drying machines are mainly caused by the following mechanisms. Moving surfaces create an under-pressure at the nip of the sheet and the top dryer. This under-pressure creates air flows which tend to lift the sheet off of the felt or fabric. These air flows are directed from the edges of the sheet towards the centre of the sheet. This is one reason for sheet-edge flutter between the top and bottom dryers of the single-felted section.

Moving surfaces create an overpressure at the nip of the felt or fabric and at the bottom dryer. If the felt or fabric is open (i.e., if it has high permeability), the air easily flows through the felt or fabric and lifts the sheet off of the felt or fabric, often across the entire sheet width. If the felt or fabric permeability is low, the air which has entered between the sheet and the felt or fabric at the nip of the sheet and the top dryer cannot escape fast enough through the felt or fabric, and an "air bubble" is created at the nip of the sheet and the top dryer. This bubble is a reason for wrinkles on the sheet.

There are a number of techniques to address this problem, e.g., blasting air out of the compression wedge to create a vacuum or using parallel jets with curved surfaces to generate a negative pressure using the Coanda effect.

One recent technique which was alleged to solve this problem involved blowing air away from the bottom of the nip of the felt or fabric and the bottom dryer and against the boundary layer carried by the felt or fabric at the nip of the felt or fabric and the top dryer. A nozzle in each end of the blow box was alleged to make it possible to maintain a slight vacuum from top to bottom dryer. The vacuum was created by the high velocity air flow from the nozzles based on ejector principles. The result was that the sheet was said to be held steadily to the felt or fabric from both of these nips. This was said to prevent the air build-up between the sheet and the felt or fabric, and to prevent the air bubble from being created at the top nip.

SUMMARY OF THE INVENTION (a) Aims of the Invention

One object of the invention is to solve the problem of instability in the sheet run on a single-felted dryer by the use of a Venturi which is used to generate a negative pressure in the compression wedge, and using the "exhaust" to generate a negative pressure across for the vacuum wedge.

Another object of the invention is to provide such solution which provides double the air to control the problem compared to the previous solutions where the air must be split using the other techniques.

Yet another object of the invention is to provide such solution using a Venturi which is easier and offers more exact control.

(b) Statements of Invention

The present invention provides a sheet stabilizer for a dryer section of a paper-making machine of the type which conveys a wet sheet of paper by way of a felt or fabric, the dryer section including a leading upper dryer roller, a lower dryer roller, and a trailing upper dryer roller, the sheet stabilizer comprising a Venturi system for stabilizing the wet sheet of paper which is being conveyed on the dryer section of the paper-making machine by way of the felt or fabric by drawing air away from the nip between the felt or fabric and the lower dryer roller, the Venturi box being disposed between a leading upper dryer roller and a trailing lower dryer roller.

The Venturi System includes two Venturi boxes, namely an upper Venturi box and a lower Venturi box. The upper Venturi box is defined by a fixed outer lateral surface and a fixed inner lateral surface, to provide a pair of spaced-apart, substantially-parallel, lateral surfaces which are configured to be at a fixed spatial relationship to one another. Those spaced-apart substantially-parallel lateral surfaces are disposed substantially-parallel to the plane of the felt or fabric. The outer lateral surface is configured to be in sliding contact with the wet sheet of paper when the felt or fabric supporting the wet sheet of paper is moving. The upper Venturi box includes means for generating a flow of a first jet of air into the space between the fixed, spaced-apart, substantially-parallel, lateral surfaces, the flow of the first jet of air thereby generating a negative pressure at the upper Venturi box. The first jet of air is then discharged into the space between the pair of spaced-apart substantially-parallel lateral surfaces, in a direction which is opposite to the direction of movement of the felt or fabric. This draws air away from the nip between the wet sheet of paper and the lower dryer roller and into the space between the pair of spaced-apart, substantially-parallel lateral surfaces, to be discharged along with the first jet of air. The lower Venturi box is defined by a fixed outer bottom surface and a fixed inner bottom surface, to provide a pair of spaced-apart, substantially-parallel, lower surfaces which are configured to be at a fixed spatial relationship to one another. These spaced-apart, substantially-parallel lower surfaces are angularly-disposed to the plane of the felt or fabric. The lower Venturi box includes means for generating a flow of a second jet of air into the space between the spaced-apart, substantially-parallel, lower surfaces. The flow of the second jet of air thereby generates a negative pressure at the lower Venturi box. The second jet of air is then discharged from the space between the spaced-apart, substantially-parallel lower surfaces, in an angular direction away from the felt or fabric supporting the wet sheet of paper. This draws air away from the nip between the wet sheet of paper and the lower dryer roller and into the space between the spaced-apart, substantially-parallel lower surfaces, to be discharged along with the second jet of air.

The present invention also provides a method for stabilizing a wet sheet of paper which is being conveyed through a dryer section of a paper-making machine by way of a moving felt or fabric. The dryer section includes a leading upper dryer roller, a lower dryer roller and a trailing upper dryer roller. The method includes generating a flow of a first jet of air in a space between a fixed outer lateral surface and a fixed inner lateral surface which define spaced-apart, substantially-parallel, lateral surfaces which are configured to be at a fixed spatial relationship to one another and which are disposed parallel to the moving felt or fabric. The wet sheet of paper is supported on the moving felt or fabric and is in sliding contact with the outer lateral surface. The flow of the first jet of air thereby generates a negative pressure at an upper Venturi box. The first jet of air is then discharged into the space between the pair of spaced-apart substantially-parallel lateral surfaces in a direction which is opposite to the direction of movement of the felt or fabric. This thereby draws air away from the nip between the wet sheet of paper and the lower dryer and into the space between the pair of spaced-apart, substantially-parallel surfaces, to be discharged along with the jet of air. A flow of a second jet of air is generated in the space between a fixed outer bottom surface and a fixed inner bottom surface which define spaced-apart, substantially-parallel, lower surfaces which are configured to be at a fixed spatial relationship to one another, and which are angularly-disposed to the plane of the moving felt or fabric. The flow of the second jet of air thereby generates a negative pressure at the lower Venturi box. The second jet of air is then discharged from the space between the spaced-apart, substantially-parallel, lower surfaces in an angular direction away from the wet sheet of paper. This thereby draws air away from the nip between the wet sheet of paper and the lower dryer roller and into the space between the spaced-apart, substantially parallel lower surfaces to be discharged along with the second jet of air.

(c) Other Features of the Invention

By one feature of the sheet stabilizer of this invention, the Venturi system comprises an air box and two Venturi boxes which are connected to the air box, and includes a respective damper in an opening in a respective interior wall between the air box and each associated Venturi box, each respective damper being selectively-movable from a fully-open position to a fully-closed position, thereby to control at least one of (i) the amount of air in the first jet of air which is discharged into the upper Venturi box, and (ii) the amount of air in the first jet of air which is discharged into the lower Venturi box.

By other features of this feature of the sheet stabilizer of this invention, and/or of the above feature thereof, the space between the pair of spaced-apart, substantially-parallel, lateral surfaces is from about ¾" to about ¼"; or the space between the pair of spaced-apart, substantially-parallel, lateral surfaces is from about ¾" to about ¼"; and the space between the pair of spaced-apart, substantially-parallel, lower surfaces is from about ¾" to about ¼".

By one feature of the method of this invention, negative pressures at the Venturi boxes are generated at each of the upper Venturi box and the lower Venturi box, by at least one of the following: at the upper Venturi box, by expelling a first jet of air at a high velocity into the throat of the upper Venturi and by angularly-discharging the jet of air into the space between the spaced-apart, substantially-parallel lateral surfaces which are configured to be at a fixed spatial relationship to one another and which is parallel to the plane of the wet sheet of paper which is supported by the felt or fabric, but in a direction which is opposite to the direction of movement of the felt or fabric; and at the lower Venturi box, by expelling a second jet of air at a high velocity into the throat of the lower Venturi and by angularly-discharging the second jet of air into the space between the spaced-apart, substantially-parallel lower surfaces which are configured to be at a fixed spatial relationship to one another and angularly to the plane of the wet sheet of paper supported by the felt or fabric.

By a feature of the method of this invention, the jets of air are expelled at a velocity which is at least one of the following: (a) the first jet of is expelled at a velocity of from about 50 to about 200 CFM/ft from the inlet opening of the upper Venturi into the throat of the upper Venturi box; and (b) the second jet of air is expelled at a velocity of from about 50 to about 200 CFM/ft from the inlet opening of the lower Venturi, into the throat of the lower Venturi box.

By other features of the method of this invention, and/or the above feature thereof, the method includes selecting the space between the spaced-apart, substantially-parallel, lateral surfaces to be from about ¼ inch to about ¾ inch; or selecting the space between the spaced-apart, substantially parallel, lower surfaces to be from about ¼ inch to about ¾ inch; or selecting the space between the spaced-apart, substantially-parallel, lateral surfaces to be from about ¼ inch to about ¾ inch; and selecting the space between the spaced-apart, substantially-parallel, lower surfaces to be from about ¼ inch to about ¾ inch.

(d) Generalized Description of the Invention

As described above, at the vacuum wedge, the small vacuum can be neutralized by creating a slight negative air pressure on e surface of the felt or fabric between the blow box and the single felt or fabric. At the compression wedge, the Venturi box itself minimizes the air flow into the nip, and the present invention uses a machine-wide slot Venturi to generate a negative pressure. The negative pressure holds the web on the felt or fabric and avoids the many problems associated therewith, e.g., sheet flutter, edge drop and folding in extreme cases.

The present invention uses a slot Venturi along the length of the Venturi box because a Venturi is more controllable than the Coanda types and all the air can be used to create a negative pressure in the compression wedge, while at the same time, the air is used, as "exhaust", from the Venturi to create a negative pressure at the vacuum wedge.

Each Venturi box includes control dampers. The control dampers control the flow of air from the air box into the respective Venturi box.

BRIEF DESCRIPTIONS OF THE DRAWINGS

In the accompanying drawings.

DESCRIPTION OF PRIOR ART

Figure 1:
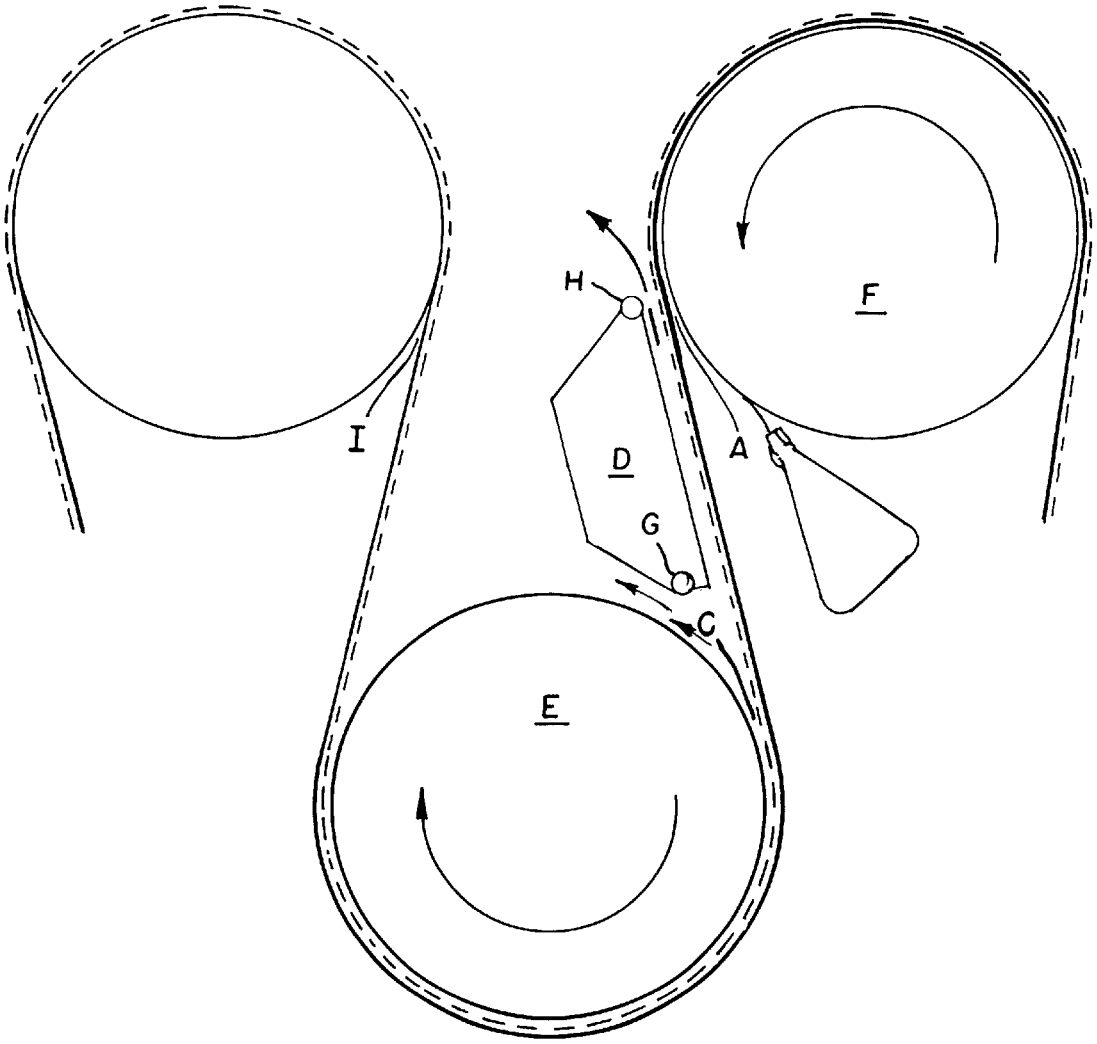
FIG. 1 PRIOR ART
FIG. 1 is an elevational view of a typical prior art attempted solution to the wet web stability problem.

As seen in FIG. 1, a primary blow box is disposed between nip (C) between the felt or fabric and the bottom dryer (E) and the nip (A) between the sheet and the top dryer (F). A nozzle (G, H) at each end of the primary blow box (D) blows air away from the bottom nip (C) and against the boundary layer carried by the felt or fabric at nip (A). There is also a nozzle in each end of the box. This structure makes it possible to maintain slight vacuum from top to bottom dryer. The vacuum is created by the high velocity air flow from the nozzles (ejector principles). The result is that the sheet is alleged to be held steadily to the felt or fabric from the nip (A) to the nip (C). This was alleged to prevent the air build-up between the sheet and the felt or fabric, and an air bubble was therefore not to be created at the tip nip (I).

DESCRIPTION OF ONE PREFERRED EMBODIMENT

Figure 2:
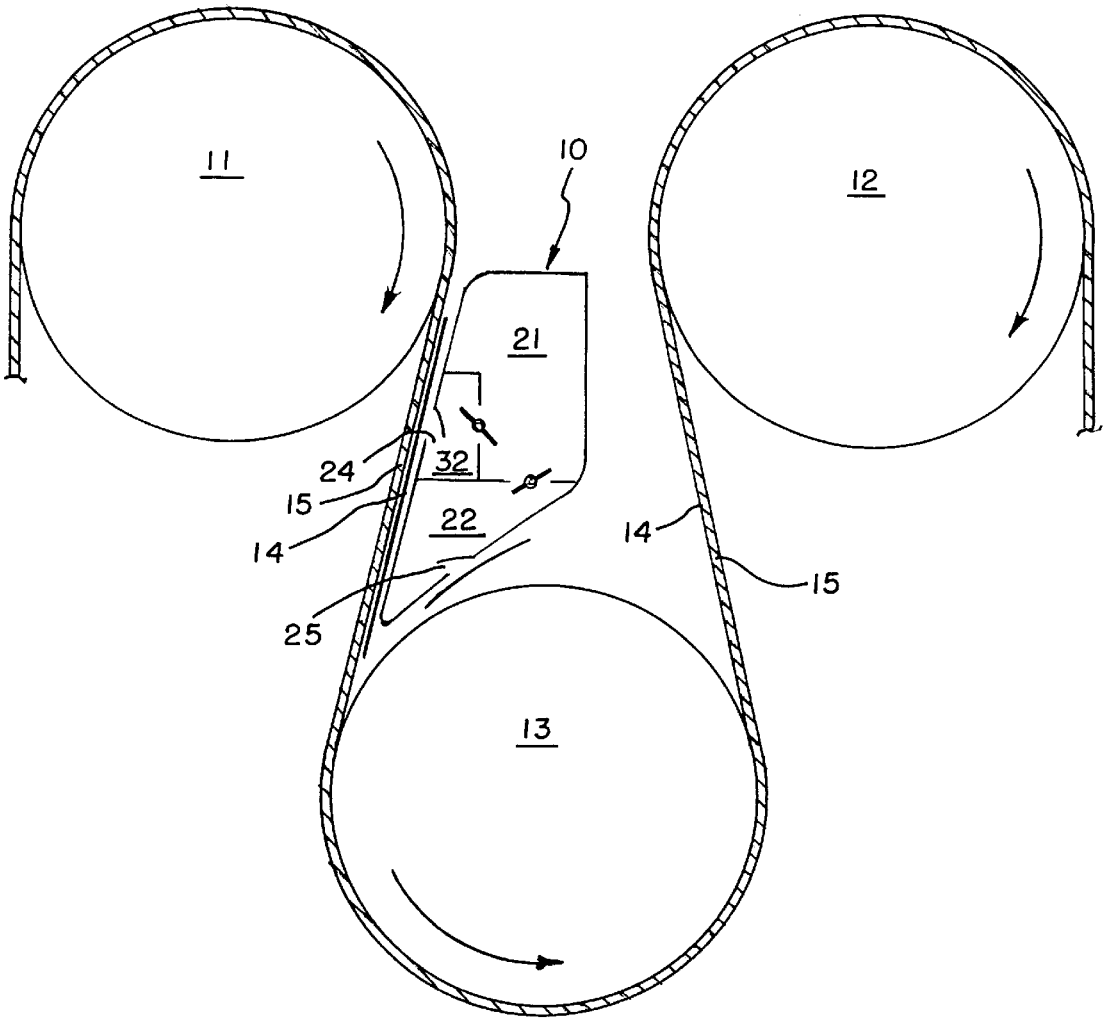
FIG. 2 is an elevational view of the solution to the wet web stability problem according to the present invention.

FIG. 2 shows the general location of the sheet stabilizer of one embodiment of the invention.

As is conventional, three dryer rollers are shown, i.e., a leading upper roller 11, a trailing upper roller 12 and a lower roller 13, which are entrained by the wet paper sheet 14 in contact with upper rollers 11 and 12, and with the felt or fabric 15 in contact with lower roller 13. The felt or fabric 15 thus supports the wet sheet of paper 14.

As seen in FIG. 2, the present invention provides a sheet stabilizer 10 which is disposed proximate to felt or fabric 15, between upper roller 11 and lower roller 13.

The sheet stabilizer 10 is in the form of an upper combination of a trapezoidal air box 21, and a lower triangular box 22 providing the sheet stabilizer 10, extending transversely across the entire width of the felt or fabric 15 and the wet paper sheet 14. The sheet stabilizer 10 is provided with an upper Venturi 24 and a lower Venturi 25.

Figure 3:
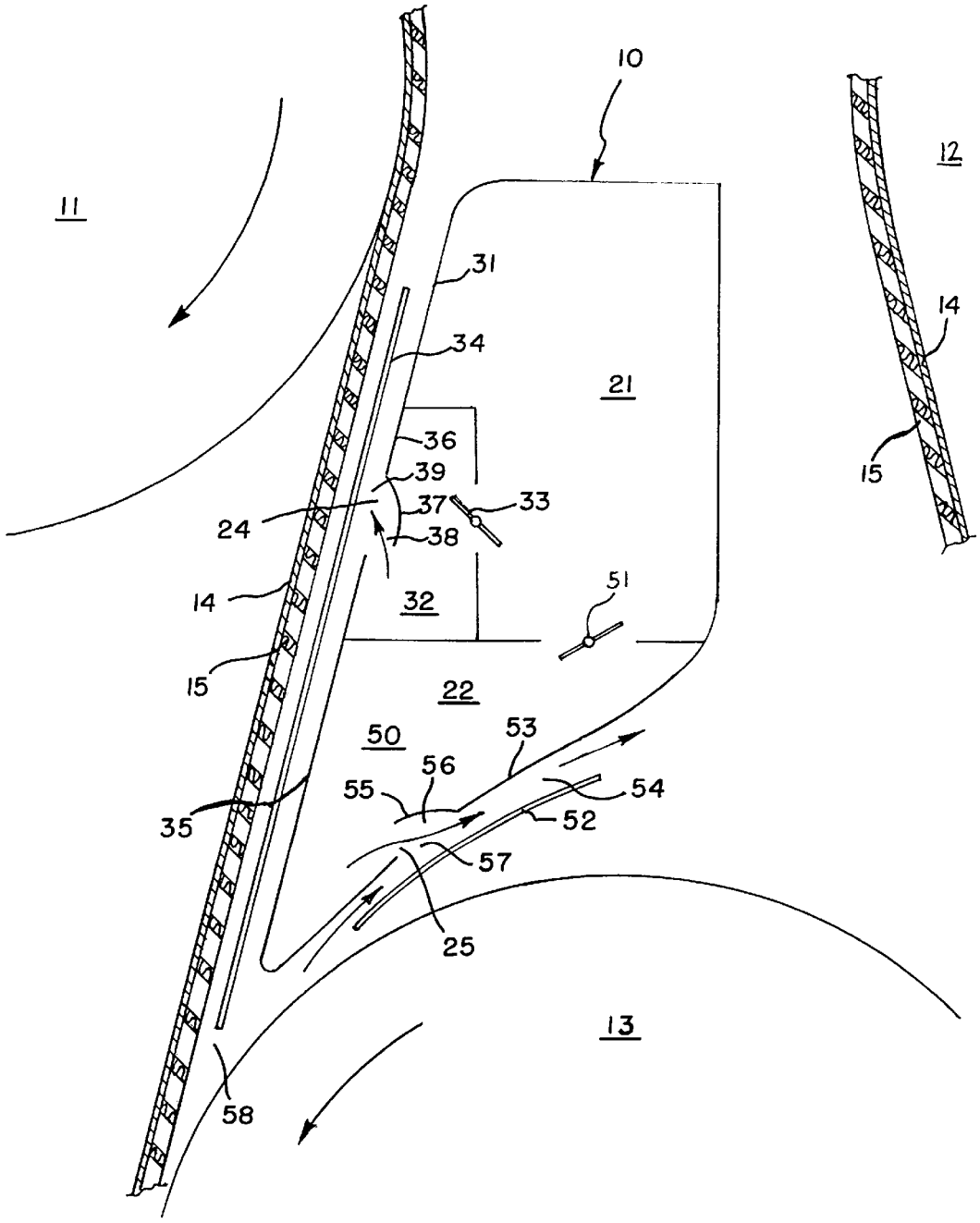
FIG. 3 is an enlarged elevational view explaining the mechanism of the present invention.

The detailed internal structure of the sheet stabilizer 10 of FIG. 2 is shown in FIG. 3. As shown in FIG. 3, the sheet stabilizer 10 includes a generally-trapezoidal air box 21 having one sloping face 31. An upper trapezoidal Venturi box 32 is disposed within air box 21. Venturi box 32 is connected to air box 21 by means of control damper 33. Sheet stabilizer 10 includes an outside plate 34, which is generally-parallel to, but spaced-apart from, sloping face 31, to provide an air channel 35 therebetween. Sloping surface 31 provides an inside plate 36 for upper Venturi 32. Inside plate 36 includes an inwardly-sloping, and then a downwardly-sloping, portion 37, whose lower end is inwardly-spaced from sloping face 31 to provide an upper exhaust nozzle 38, to generate upper Venturi nozzle 39 of upper Venturi 24, as shown by the exiting arrow.

Triangular box 22 of the sheet stabilizer 10 provides a lower Venturi 50. Triangular box 22 is connected to air box 21 by control damper 51. Lower Venturi 50 includes a lower outside plate 52, which is generally-parallel to, but spaced-apart from, inside plate 53, to provide a lower air channel 54 therebetween. Inside plate 53 is provided with an inwardly-extending generally-horizontal arcuate portion 55 whose lower, outer end is upwardly-spaced from inside plate 53 to provide a lower exhaust nozzle 56, to generate lower Venturi throat 57, as shown by the exiting arrow.

The apex of sloping face 31 and lower inside plate 53 is sited adjacent to the nip 58 between the felt 15 and the lower roller 13.

OPERATION OF THE PRESENT INVENTION

Thus, the present invention solves the problem that, in a "Uni-Run" section of a paper machine, air travelling with the felt or fabric is forced into the nip formed by the sheet, the felt or fabric and the dryer. The air thus forced, creates a positive pressure in the nip which pushes air through the permeable felt or fabric thus creating stability problems on the sheet.

This sheet stabilizer is based on the use of a Venturi. A Venturi is a device in which air with a high static pressure and low velocity is forced through a "throat" where the velocity is increased to a high level. The static pressure is converted to velocity pressure. If the velocity is high enough, the static pressure in the throat can actually become negative. Proper design of the Venturi will ensure that the desired pressure are obtained. Equations governing Venturi design are well known. A Venturi, properly designed, will have a suction that is definitive and quantitive. This suction, in turn, is used to stabilize the paper sheet.

The sheet stabilizer of this invention includes dampers. Each Venturi has a separate damper which allows the modulation or biassing of the entrained air volume and the suction which is generated.

The felt or fabric is a conventional felt or fabric, i.e., the felt or fabric should preferably be of 100% monofilament construction. The permeability should be in the range of 75 to 100 cfm.

The present invention draws air away from the nip by means of two Venturi systems namely, an upper Venturi and a lower Venturi. The upper Venturi draws air away from the nip and expels it into the open space between the two top dryers. The lower Venturi also draws air from the nip and expels it into the pocket formed by the dryers. The suction for each of the two Venturis is controlled by their respective dampers.

By means of damper 33, which is operatively-disposed between air box 21 and upper Venturi 32, primary air to upper Venturi nozzle 38 may be controlled and, thereby, the amount of exhaust and suction that is generated by the sheet stabilizer 10 can be controlled. In addition, such damper allows the modulation or biassing of the entrained air volume and suction pressure generated.

Similarly, by means of damper 51 which is operatively-disposed between air box 21 and lower Venturi 50, primary air to lower Venturi nozzle 57 may be controlled and, thereby, the amount of exhaust and suction that is generated by the sheet stabilizer 20. In addition, such damper allows the modulation or biassing of the entrained air volume and suction pressure which is generated.

There is a relationship between suction pressure and the distance between the felt or fabric, and the sheet stabilizer. Up to 1.0 inches of negative pressure can be developed with a ½" gap. This suction, however, drops off rapidly above ½". The distance should vary from about ¼" to ¾". However, ½" has been selected as an optimum operating distance, i.e., the width of air channels 35 and 54.

The air flow to the air box 21 is set at start-up. The manual dampers 33 and 51 are set to assure that there is an air flow of from about 50 to about 200 CPM/ft from the inlet opening (38,56) of the Venturi (32,50) into the throat (39,57) of the Venturi (32,50), all respectively.

One suitable air flow into the air box 21 is about 4820 cfm. The air pressure generally is about 7.25". To provide optimum drying, the minimum air temperature should be about 76° C. to 85° C.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

What is claimed is:

1. A sheet stabilizer for a dryer section of a paper-making machine of the type which conveys a wet sheet of paper by way of a moving felt or fabric, said dryer section including a leading upper dryer roller, a lower dryer roller, and a trailing upper dryer roller, said sheet stabilizer comprising a Venturi system for stabilizing said wet sheet of paper which is being conveyed on said section of said paper-making machine and being supported on said felt or fabric by drawing air away from the nip between the wet sheet of paper and said lower dryer roller, said Venturi system being disposed between said leading upper dryer roller and said lower dryer roller, said Venturi system including two Venturi boxes, each of which extend across the entire width of said felt or fabric, said two Venturi boxes comprising:

(i) an upper Venturi box, said upper Venturi box being defined by a fixed outer lateral surface and a fixed inner lateral surface, to provide a pair of spaced-apart, substantially-parallel lateral surfaces which are configured to be at a fixed spatial relationship to one another, said spaced-apart substantially-parallel lateral surfaces which are configured to be at a fixed spatial relationship to one another, and being disposed substantially-parallel to the plane of said felt or fabric, said outer lateral surface being configured to be in sliding contact with said wet sheet of paper when said felt or fabric supporting said wet sheet of paper is moving, said upper Venturi box including means for generating a flow of a first jet of air into a space between said spaced-apart, substantially-parallel, lateral surfaces which are configured to be at a fixed spatial relationship to one another, said flow of said first jet of air thereby generating a negative pressure at said upper Venturi box, said first jet of air then being discharged into said space between said pair of spaced-apart substantially-parallel lateral surfaces which are configured to be at a fixed spatial relationship to one another, in a direction which is opposite to the direction of movement of said felt or fabric, thereby to draw air away from the nip between said wet sheet of paper and said lower dryer roller and into said space between said pair of spaced-apart, substantially-parallel lateral surfaces, to be discharged along with said first jet of air; and (ii) a lower Venturi box, said lower Venturi box being defined by a fixed outer bottom surface and a fixed inner bottom surface, to provide a pair of spaced-apart, substantially-parallel, lower surfaces which are configured to be at a fixed spatial relationship to one another, said spaced-apart, substantially-parallel lower surfaces which are configured to be at a fixed spatial relationship to one another, being angularly-disposed to the plane of said felt or fabric, said lower Venturi box including means for generating a flow of a second jet of air into a space between said spaced-apart, substantially-parallel, lower surfaces which are configured to be at a fixed spatial relationship to one another, said flow of said second jet of air thereby generating a negative pressure at said lower Venturi box, said second jet of air then being discharged from said space between said spaced-apart, substantially-parallel lower surfaces which are configured to be at a fixed spatial relationship to one another, in an angular direction away from said felt or fabric supporting said wet sheet of paper, thereby to draw air away from the nip between said wet sheet of paper which is supported on said felt or fabric and said lower dryer roller and into said space between said spaced-apart, substantially-parallel lower surfaces which are configured to be at a fixed spatial relationship to one another, to be discharged along with said second jet of air.

2. The sheet stabilizer of claim 1, wherein said Venturi system comprises an air box and two Venturi boxes, and including a respective damper in an opening in a respective interior wall between said air box and each of said two Venturi boxes, each said respective damper being selectively-movable from a fully-open position to a fully-closed position, thereby to control at least one of:

(i) the amount of air in said first jet of air which is discharged into said upper Venturi box; and (ii) the amount of air in said second jet of air which is discharged into said lower Venturi box.

3. The sheet stabilizer of claim 1, wherein said space between said pair of spaced-apart, substantially-parallel lateral surfaces is from about ¾" to about ¼".

4. The sheet stabilizer of claim 1, wherein said space between said pair of spaced-apart, substantially-parallel lower surfaces is from about ¾". to about ¼".

5. The sheet stabilizer of claim 1 wherein said space between said pair of spaced-apart, substantially-parallel lateral surfaces is from about ¾" to about ¼"; and wherein said space between said pair of spaced-apart, substantially-parallel lower surfaces is from about ¾" to about ¼".

6. The sheet stabilizer of claim 1 wherein the air flow into said air box is about 4820 cfm.

7. The sheet stabilizer of claim 1 wherein said air has a temperature of about 76° C. to about 85° C.

8. A method for stabilizing a wet sheet of paper which is being conveyed through a dryer section of a paper-making machine by way of a moving felt or fabric, said dryer section including a leading upper dryer roller, a lower dryer roller and a trailing upper dryer roller, said method comprising:

generating a flow of a first jet of air into a space between a fixed outer lateral surface and a fixed inner lateral surface which define spaced-apart, substantially-parallel, lateral surfaces which are configured to be at a fixed spatial relationship to one another, said spaced-apart, substantially-parallel lateral surfaces being disposed parallel to said moving felt or fabric, said wet sheet of paper which is supported on said moving felt or fabric being in sliding contact with said outer lateral surface, said flow of said first jet of air thereby generating a negative pressure at an upper Venturi box, and then discharging said first jet of air into said space between said pair of spaced-apart substantially-parallel lateral surfaces which are configured to be at a fixed spatial relationship to one another in a direction which is opposite to the direction of movement of said felt or fabric, thereby to draw air away from the nip between said wet sheet of paper which is supported on said felt or fabric and said lower dryer and into said space between said pair of spaced-apart, substantially-parallel surfaces which are configured to be at a fixed spatial relationship to one another, to be discharged along with said jet of air; and generating a flow of a jet of second air into a space between a fixed outer bottom surface and a fixed inner bottom surface which define spaced-apart, substantially-parallel, lower surfaces which are configured to be at a fixed spatial relationship to one another, said spaced-apart, substantially-parallel lower surfaces being angularly-disposed to the plane of said moving felt or fabric, said flow of said second jet of air thereby generating a negative pressure at a lower Venturi box, and then discharging said second jet of air from said space between said spaced-apart, substantially-parallel, lower surfaces which are configured to be at a fixed spatial relationship to one another in an angular direction away from said wet sheet of paper supported by said felt or fabric, thereby to draw air away from the nip between said wet sheet of paper which is supported by said felt or fabric and said lower dryer roller and into said space between said spaced-apart, substantially parallel lower surfaces which are configured to be at a fixed spatial relationship to one another to be discharged along with said second jet of air.

9. The method of claim 8, wherein negative pressures at said Venturi boxes are generated at each of said upper Venturi and said lower Venturi, by at least one of:

(a) at said upper Venturi, by expelling a first jet of air at a high velocity into a throat of said upper Venturi and by angularly-discharging said jet of air into said space between said spaced-apart, substantially-parallel lateral surfaces which are configured to be at a fixed spatial relationship to one another and which is parallel to the plane of said wet sheet of paper which is supported by said felt or fabric, but in a direction which is opposite to the direction of movement of said felt or fabric; and (b) at said lower Venturi box, by expelling a second jet of air at a high velocity into a throat of said lower Venturi and by angularly-discharging said second jet of air into said space between said spaced-apart, substantially-parallel lower surfaces which are configured to be at a fixed spatial relationship to one another and angularly to the plane of said wet sheet of paper supported by said felt or fabric.

10. The method of claim 8, wherein said jets of air are expelled at a velocity which is at least one of the following:

(a) said first jet of air being expelled at a velocity of from about 50 to about 200 CFM/ft from the inlet opening of said upper Venturi into the throat of said upper Venturi box; and (b) said second jet of air being expelled at a velocity of from about 50 to about 200 CFM/ft from the inlet opening of said lower Venturi, into the throat of said lower Venturi box.

11. The method of claim 8, which comprises selecting the space between said spaced-apart substantially-parallel lateral surfaces to be from about ¼ inch to about ¾ inch.

12. The method of claim 8, which comprises selecting the space between said spaced-apart substantially-parallel lower surfaces to be from about ¼ inch to about ¾ inch.

13. The method of claim 8, wherein the flow of air into said air box is about 4820 cfm.

14. The method of claim 8, wherein the temperature of said air is about 76° C. to about 85° C.

* * * * *